United States Patent [19]

Giroux et al.

[11] 4,299,339

[45] Nov. 10, 1981

[54] SAFETY POURING CLOSURE

[75] Inventors: Maurice Giroux, Tournus; Paul Sivignon, Cuisery; Claude Susini, Tournus, all of France

[73] Assignee: Societe de Moulage de Tournus, Creteil, France

[21] Appl. No.: 135,518

[22] Filed: Mar. 31, 1980

[30] Foreign Application Priority Data

Jul. 4, 1979 [FR] France ..... 79 17320

[51] Int. Cl.[3] ..... B67B 5/00

[52] U.S. Cl. ..... 222/153; 215/313; 222/548

[58] Field of Search ..... 222/548, 556, 557, 565, 222/517, 544, 562, 484–486, 480, 153; 215/313

[56] References Cited

U.S. PATENT DOCUMENTS

| | | | |
|---|---|---|---|
| 1,300,896 | 4/1919 | Taliaferro | 215/313 |
| 2,072,432 | 3/1937 | Solomon | 222/557 |
| 3,249,529 | 5/1966 | Corsette | 222/321 |
| 3,342,385 | 9/1967 | Knight | 222/485 |

*Primary Examiner*—H. Grant Skaggs

*Attorney, Agent, or Firm*—Fisher, Gerhardt, Crampton & Groh

[57] ABSTRACT

A safety pouring closure comprises an inner cap and an outer cap assembled together by snap-engagement, each cap having an off-center orifice, the caps being capable of being rotated relatively between an open position in which the orifices are aligned and a closed position in which the orifices are angularly off-set, at least one blocking lug on the cap engaging in a recess in the cap in the closed position, the lug being capable of being disengaged from the recess by elastic deformation of the cap. The invention is applicable to closures for containers containing products dangerous to children.

10 Claims, 6 Drawing Figures

SAFETY POURING CLOSURE

The present invention relates to a safety pouring closure, in particular for a container which contains a product, access to which by young children would be dangerous. Products of this kind are often used for domestic purposes and one can refer in particular to cleaning products such as detergents and scouring powders, where the operation of opening and closing the container containing such products must be easy and rapid for an adult, yet should present a insurmountable difficulty for young children.

In most of the safety closures known up to the present, the child-resistance is obtained by rotation-preventing means mounted on the one hand on the closure and on the other hand on the container. When such a closure is fitted onto the container it requires not only axial alignment but equally precise orientation with respect to the container. The assembly step is thus made more complex and takes more time.

The aim of the present invention is to provide a safety closure of simple construction and low market price and which can be mounted on the container rapidly and without prearranged orientation with respect to the container.

The subject of the present invention is a safety pouring closure for a container comprising two co-axial caps, one within the other, and having means for preventing axial relative movement between them, the inner cap having means for securing it onto the neck of a container, the top wall of each cap having an off-center orifice, the said caps being capable of being rotated relative to one another between an open position in which the said orifices are aligned and a closed position in which the said orifices are angularly off-set, one of the said caps comprising at least one lug that prevents rotation, engaging in a recess of complementary form in the other cap when the said caps are in the closed position, the said lug being capable of being disengaged from the said recess by elastic deformation of the side wall of the outer cap.

In the closure according to the invention the safety means, that is to say the locking lug and the recess of complementary form, are mounted solely on the caps and so they can be assembled together in the closed position before being mounted on the container.

The means for securing to the neck of the container preferably comprise at least portions of annular ribs and vertical flutes on the inner face of the inner cap, the neck of the container having, in a corresponding manner, an annular groove in which portions of the said ribs snap, thus ensuring axial location of the closure, whilst vertical flutes on the neck of the container co-operate with the vertical flutes of the cap to prevent rotation. The mounting of the closure can thus be achieved rapidly by simple snap engagement onto the neck of the container.

According to one embodiment of the invention, the means for axially locating the caps with respect to each other comprise an annular rib on one of the said caps and at least portions of ribs arranged in a circle in the other cap, the said rib and said portions of ribs being disposed respectively on opposed faces of the side walls of the said caps.

The subject of the invention is likewise a container adapted to receive a closure of the kind stated.

The invention will be better appreciated by reading the following detailed description with the accompanying drawings which illustrate, by way of non-limiting example, one embodiment of the invention.

Figure 1:
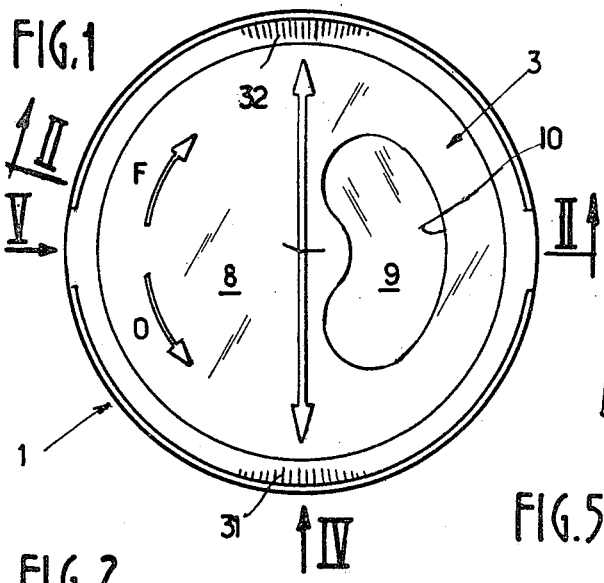
FIG. 1 is a view from above of the pouring closure according to the invention.
Figure 4:
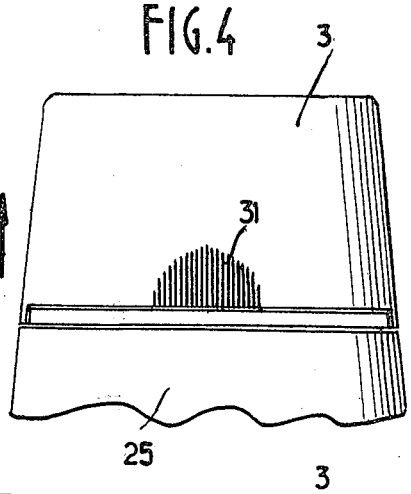
FIG. 4 is a view in the direction IV in FIG. 1.
Figure 5:
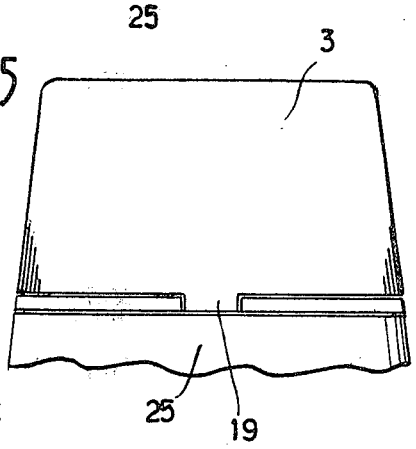
FIG. 5 is a view in the direction V in FIG. 1.
Figure 2:
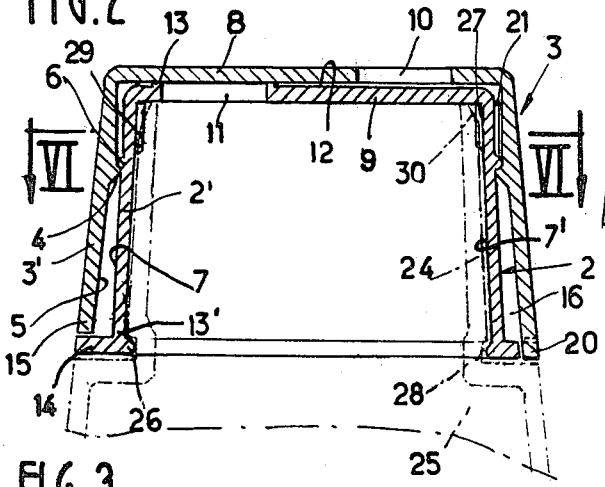
FIG. 2 is a section on the line II—II in FIG. 1, a container on which the closure is mounted being illustrated partially in broken lines.

A safety pouring closure according to the invention comprises an inner cap 2 and an outer cap 3 co-axially arranged one upon the other. Means for holding the caps 1 and 2 together axially are constituted by an annular rib 4 on the inner face 5 of the side wall 3' of the outer cap 3 and an annular rib 6 on the outer face 7 of the side wall 2' of the inner cap 2. When the top walls 8 and 9 of the outer cap 3 and the inner cap 2 respectively are in contact, the rib 4 is below the rib 6 and so the caps 2 and 3 are held together by simple snap engagement.

The top wall 8 of the outer cap 3 and the top wall 9 of the inner cap 2 each have an off-centre orifice 10 and 11 respectively, and the caps 2 and 3 can be rotated relative to one another between a closed position (as shown in the drawings) in which the orifices 10 and 11 are angularly off-set from one another (they are diametrically opposed in the drawings) and an open position (not shown) in which the orifices 10 and 11 are aligned.

The outer face 12 of the top wall 9 of the inner cap 2 has a rib 13 around the orifice 11. This rib 13 on which the top wall 8 of the outer cap 3 engages, ensures sealing in the closed position and allows a reduction in the frictional forces on relative rotation of the caps 2 and 3.

The lower end 13' of the inner cap 2 has an annular flange 14 pointing outwards. The outer cap 13 has a substantially frusto-conical axial section, diverging towards its lower end 15, the outer diameter of the lower end 15 matching substantially the outer diameter of the flange 14 of the inner cap 2. Thus the closure 1 has a clearance 16 between the inner and outer caps 2 and 3.

Figure 3:
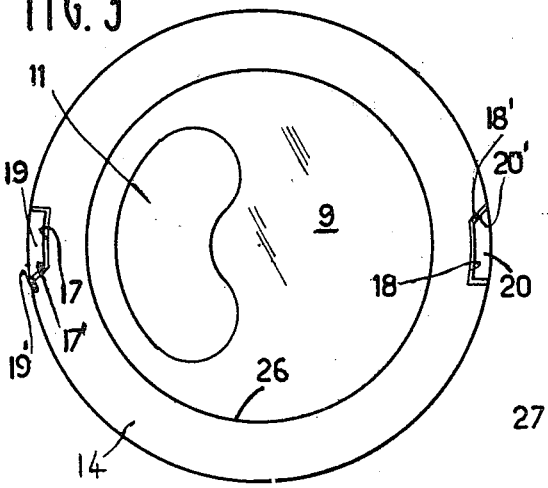
FIG. 3 is a view from below of the closure of FIG. 1.

The flange 14 has two diametrically opposed notches 17 and 18, in which are engaged, in the closed position, a locking lug 19 and a locking lug 20 respectively. The lugs 19 and 20 are formed by an extension of the lower end 15 of the outer cap 3. A side face 19' of the lug 19 and a corresponding face 17' of the notch 17 are chamfered (FIG. 3) and the same applies to a side wall 20' of the lug 20 and a corresponding face 18' of the notch 18, so as to facilitate this engagement of the lugs 19, 20 for closing the closure.

The opposed faces 5 and 7 of the side walls 3' and 2' of the caps 3 and 2 have abutment means that limit the relative rotation of the caps 3 and 2 between the open and closed positions. These abutment means comprise a substantially vertical rib 21 on the face 7 of the cap 2 and two substantially vertical ribs 22 and 23 on the face 5 of the cap 3. The rib 21 extends from the top wall 9 of the cap 2 to the annular rib 6, and the ribs 22 and 23 extend from the top wall 8 of the cap 8 to the annular rib 4. The ribs 21, 22 and 23 are placed so that in the closed position the rib 22 abuts against the rib 21 whereas in the open position the rib 23 abuts against the rib 21.

Means for securing the closure 1 to the neck 24 of a container 25 are constituted by an annular rib 26 (FIG.

6) on the inner face 7′ of the inner cap 2 and forming a continuation of the flange 14, and by vertical flutes 27 on the upper part of the inner face 7′.

The neck 24 of the container 25 has an annular groove 28 and vertical flutes 29 which co-operate respectively with the inner rib 26 and the vertical flutes 27 on the inner face 7′ of the inner cap 2. It will be noted that the upper end 30 of the neck 24 is chamfered so as to facilitate mounting of the closure 1 on the container 25 by snap engagement. The inner and outer caps 2 and 3 are made of flexible plastics material, for example polypropylene.

The closure according to the invention is used in the following manner:

In the closed position illustrated in the drawings the lugs 19 and 20 engage in the notches or recesses 17 and 18 such that it is impossible to rotate the cap 3 with respect to the cap 2. The rib 21 abuts against the rib 22.

Figure 6:
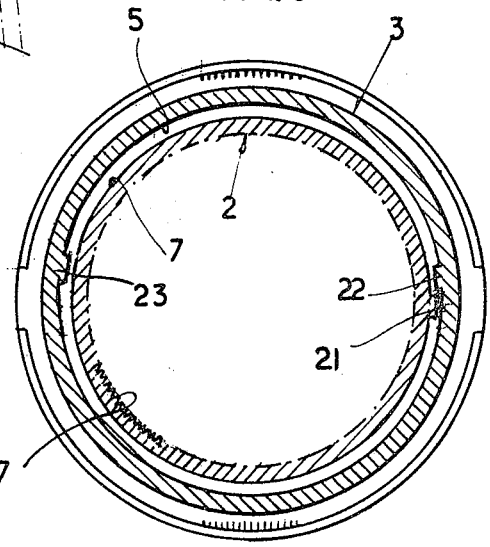
FIG. 6 is a section on the line VI—VI in FIG. 1.

To open the cap, lateral pressure is exercised in two diametrically placed regions 31 and 32, each displaced about 45° with respect to the lugs 19 and 20. The outer cap is thereby subjected to elastic deformation to an oval shape, causing the lugs 19 and 20 to become disengaged from the notches 17 and 18. One can then turn the outer cap 3 through about 180° in the direction of the arrow O (FIG. 1) until the orifice 10 comes into alignment with the orifice 11. At the same time the rib 23 (FIG. 6) comes up against the rib 21.

Return to the closed position is effected by rotation in the opposite direction, shown by the arrow F.

It will be understood that the invention is by no means limited to the example described and illustrated but is open to numerous modifications available to an expert in the art, according to the uses envisaged and without departing from the scope of the invention.

We claim:

1. A safety pouring closure for a container comprising: a pair of coaxial caps arranged one upon the other and having means for holding them against axial displacement relative to each other, the inner cap having means for securing it to the neck of a container, the top wall of each cap having an off-center orifice, said caps being capable of rotation relative to each other between an open position in which said orifices are aligned and a closed position in which said orifices are angularly offset, one of said caps having at least one rotation preventing lug engaged in a complementary recess in the other cap when said caps are in the closed position, said lug being capable of being disengaged from said recess by elastic deformation of the side wall of the outer cap disposed in diametrically spaced regions of elastic deformation spaced circumferentially from said lugs, said inner cap having an annular flange pointing outwards and said outer cap having a frusto-conical axial section diverging towards its lower end, the outer diameter of the lower end of the outer cap corresponding substantially to the outer diameter of the flange on the inner cap, said flange having at least one notch engaged in the closed position by a blocking lug formed by an extension of the lower end of the outer cap.

2. A closure according to claim 1 characterised in that there is a clearance between the side walls of the inner cap and the outer cap at least in the region of elastic deformation of the side wall of the outer cap.

3. A closure according to claim 1 characterised in that the outer face of the top wall of the inner cap has a rib around the orifice in that cap, the top wall of the outer cap engaging the said rib.

4. A closure according to claim 1 characterised in that at least one wall of the side of the notch and the corresponding side of the lug are chamfered.

5. A closure according to claim 1 characterised in that the opposed faces of the side walls of the said caps have abutment means limiting the relative rotation of the said caps between the open and closed positions.

6. A closure according to claim 1 characterised in that the means for securing to the neck of a container comprise, on the inner face of the inner cap, at least portions of annular ribs and vertical flutes.

7. A closure according to claim 6 characterised in that the means for securing to the neck of a container comprise an annular rib on the inner face of the inner cap, the said rib being situated as a continuation of the external flange on the lower end of the said inner cap.

8. A closure according to claim 1 and further comprising axial locating means for the caps with respect to one another including an annular rib on one of the said caps and at least portions of ribs arranged in a circle on the other cap, the said rib and the said portions of rib being disposed respectively on the opposed faces of the side walls of the said caps.

9. A safety pouring closure and container comprising a closure including a pair of coaxial caps arranged one upon the other and means for holding them in axially fixed relationship to each other, means for securing the inner cap to the neck of said container, the top wall of each cap having an off-center orifice, said caps being capable of rotation relative to each other between an open position in which said orifices are aligned and a closed position in which said orifices are angularly offset, one of the cap having at least one rotation preventing lug engaged in a complementary recess in the other cap when said caps are in the closed position, said lug being capable of being disengaged from said recess by elastic deformation of the side wall of the outer cap in diametrically spaced regions of elastic deformation circumferentially spaced from said lug, said container having a neck, said neck forming an annular groove and vertical flutes, said inner cap having an inner rib and vertical flutes on the inner face of the inner cap cooperating with said annular groove and vertical flutes on said neck.

10. Container according to claim 9 characterised in that the upper end of the neck of the said container has an chamfered wall.

* * * * *